United States Patent [19]

Bertoldi

[11] 3,949,579

[45] Apr. 13, 1976

[54] APPARATUS FOR FABRIC PROCESSING

[76] Inventor: Attilio Bertoldi, Via Luzzago 27, Manerbio (Brescia), Italy

[22] Filed: Jan. 25, 1974

[21] Appl. No.: 436,471

[30] Foreign Application Priority Data

Feb. 13, 1973 Italy ..... 20325/73
Sept. 17, 1973 Italy ..... 28964/73

[52] U.S. Cl. ..... 68/152; 68/179
[51] Int. Cl.² ..... D06B 3/10; D06B 17/02
[58] Field of Search ..... 68/158, 53, 170, DIG. 1, 68/148, 152–156, 177–179; 26/20, 21

[56] References Cited

UNITED STATES PATENTS

| | | | |
|---|---|---|---|
| 1,041,031 | 10/1912 | Craig | 68/178 X |
| 2,826,057 | 3/1958 | Olson | 68/53 |
| 3,631,692 | 1/1972 | Garzotto | 68/152 X |
| 3,690,128 | 9/1972 | Biesinger | 68/158 |

FOREIGN PATENTS OR APPLICATIONS

| | | | |
|---|---|---|---|
| 1,097,322 | 2/1955 | France | 68/178 |
| 501,323 | 11/1954 | Italy | 68/178 |
| 244,287 | 10/1969 | U.S.S.R. | 68/178 |
| 573,300 | 3/1959 | Canada | 68/158 |

*Primary Examiner*—Stanley N. Gilreath
*Assistant Examiner*—Philip R. Coe
*Attorney, Agent, or Firm*—Steinberg & Blake

[57] ABSTRACT

Apparatus for fabric processing, comprising a tank provided with a bottom and suitable for containing a certain amount of processing liquid, and a liquid pervious channel within the tank, at least partly submersible in the liquid, receiving the fabric to be processed and operated by driving means imparting thereto at least a movement to and away from the tank bottom.

10 Claims, 5 Drawing Figures

APPARATUS FOR FABRIC PROCESSING

This invention relates to an apparatus for fabric processing, and more particularly for continuous and/or batch fabric washing and/or fulling, and also for fabric dyeing.

There are several types of apparatus for fabric washing or dyeing. A known type comprises a tank containing the processing liquid and above the tank a pair of cylinders resiliently pressed against each other, of which one cylinder is driven, the cylinders supplying the fabric in a channel provided with a wall which is hinged and resiliently pressed against the opposite wall, so as to provide a standstill for the fabric that at the outlet reaches the tank before re-entering between the pair of cylinders above mentioned. However, such apparatus are disadvantageous in that the water, aqueous washing solution, solvent or dyeing bath do not thoroughly operate in the fabric, whereby the results are to be considered as unsatisfactory, unless extending the process for economically undesirable periods.

Even the fulling of delicate fabrics, which have to undergo a light fulling, when carried out in machines substantially similar to washers, is not satisfactory since the fulling effect either cannot be thoroughly carried on, or may damage the fabric.

It is the object of the present invention to provide for fabric processing, such as washing and/or fulling or dyeing, affording a proper processing of the latter in short times.

An apparatus according to the invention comprises a tank for containing a certain amount of processing liquid and a liquid pervious channel, located in the tank and at least partly submersible in the liquid, this channel receiving the fabric to be processed and being operated by driving means imparting thereto at least a movement to and away from the tank bottom.

The back and forth motion given to the channel causes a relatively violent passage of the processing liquid through the fabric, with a resulting effective action throughout the parts or zones, even the most intimate of the fabric.

In order to impart the back and forth motion to the channel, the latter is hinged at an end thereof, while bearing at the other end on cams operated by a driving unit.

According to the invention, the fabric is fed along the channels, and to this end use can be made of pairs of rotably driven cylinders between which the fabric moves, or baffles can be attached to the channel structure, so that, as the channel oscillates, the liquid is caused to enter the channel at a suitable angle for providing a feeding action on the fabric, which baffles could be also used in combination with said cylinders.

In order to enhance the effect of the processing liquid action, it is contemplated according to the invention that the lower contour of the channel is at least partly provided with a seal cooperating with a counterseal on the tank bottom, so that when the channel is lowered, the liquid will not leak laterally of the channel, but will be caused to move through the latter. The invention will be more clearly understood from the following detailed description of two embodiments thereof, given by mere way of not limiting example and shown in the accompanying drawings, in which.

Figure 1:
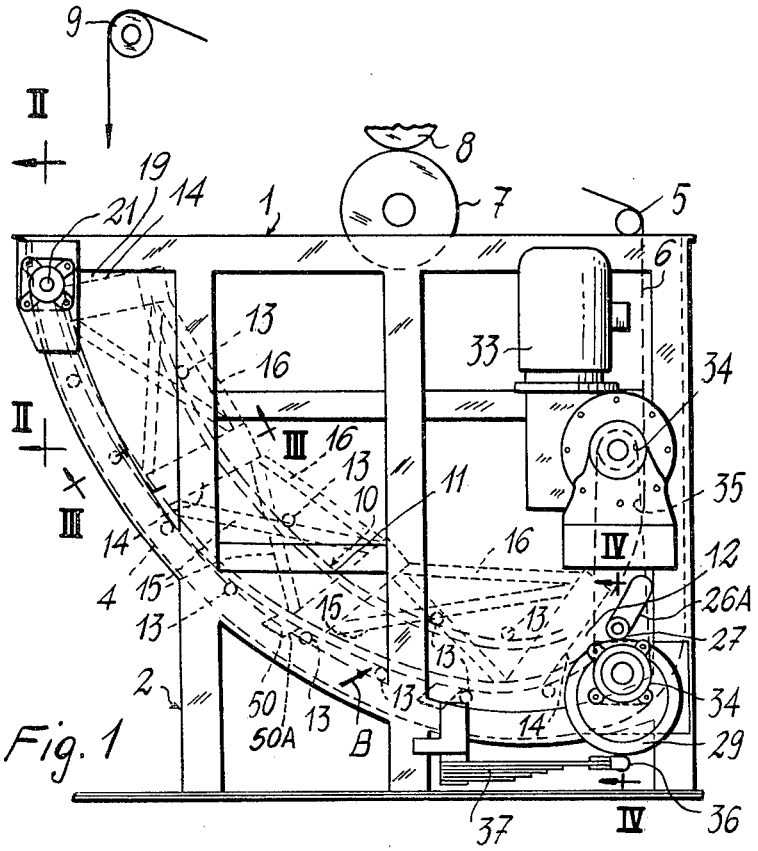
FIG. 1 is a side elevational view of the apparatus according to the invention.
Figure 2:
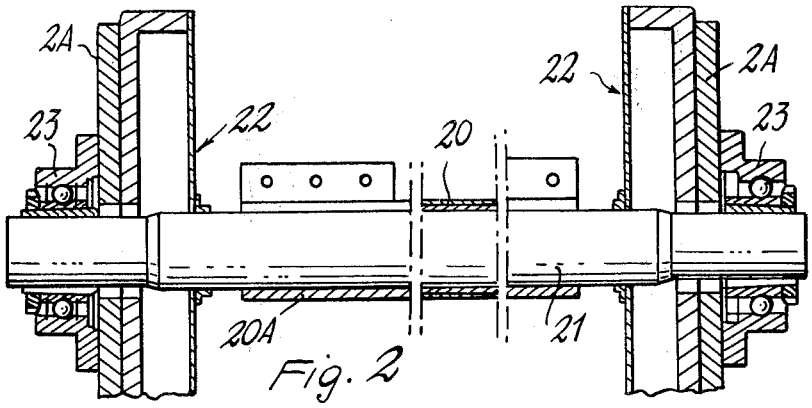
FIG. 2 is a fragmentary sectional view taken along the line II—II of FIG. 1.
Figure 3:
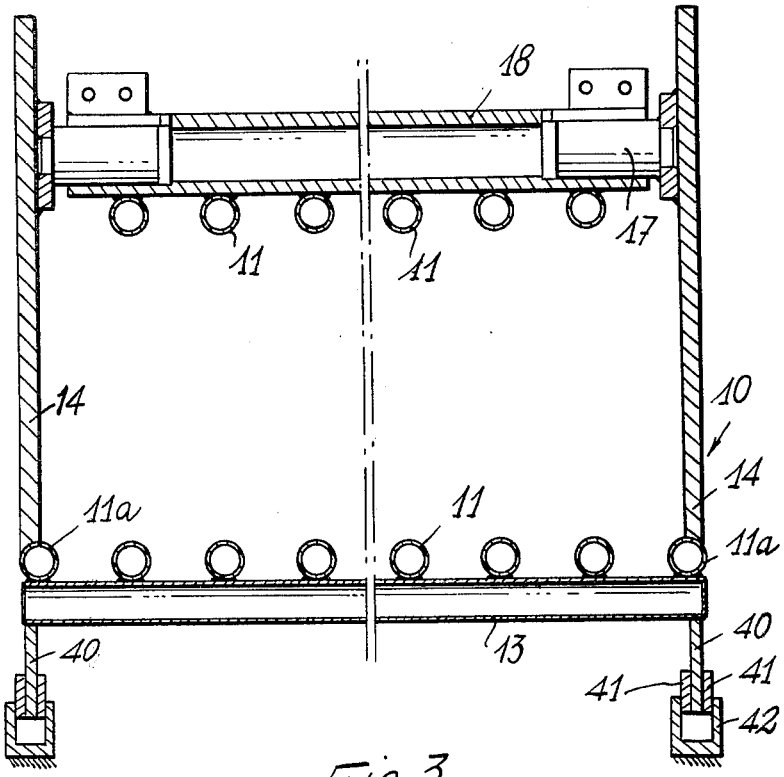
FIG. 3 is a fragmentary sectional view taken along the line III—III of FIG. 1.
Figure 4:
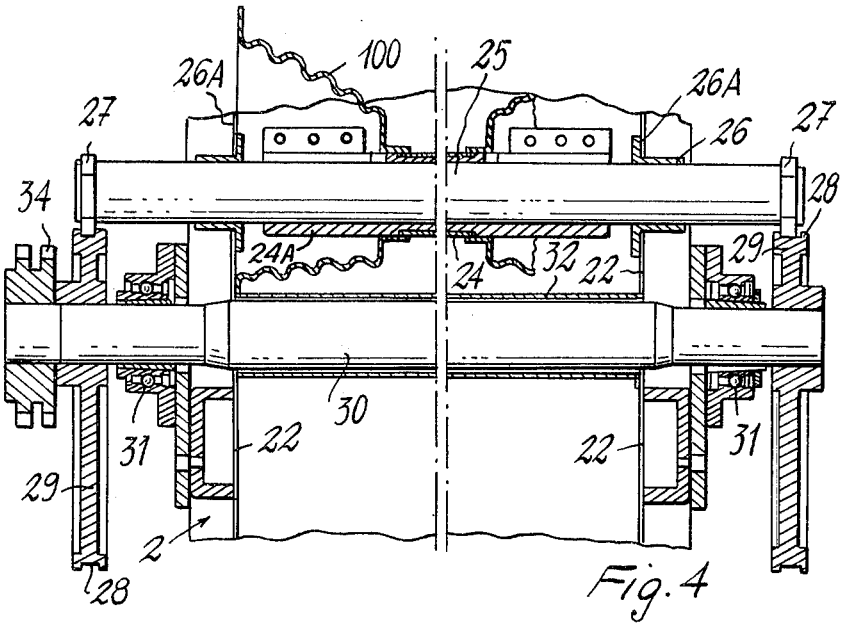
FIG. 4 is a fragmentary sectional view taken along the line IV—IV of FIG. 1, wherein some parts have been omitted.

Referring to FIGS. 1–4 of the drawings, the apparatus shown therein comprises a tank 1 carried by a bearing structure 2 made of sections and resting on a base. In this embodiment, the tank bottom 4 is of curvilinear configuration.

By means not shown, but well known, said structure 2 carries above the tank a first idler cylinder 5 for back or return movement of the fabric 6, a pair of cylinders 7 and 8 resiliently pressing against each other, one of which being driven in any known manner, and between which the fabric 6 moves, and a cylinder 9 directing the fabric downwardly from the pair of driving cylinders 7 and 8. To this end, reference can be had, for example, to U.S. Pat. Nos. 3,475,927 and No. 3,001,261.

A pervious channel 10 is arranged within the tank 1 and has a pattern approximately following that of the tank bottom 4, that is suitable for enabling the passage of the processing liquid which is supplied into the tank in any known manner.

This channel 10 is of rectangular cross-section (FIG. 3) and on its lower and upper sides comprises a set of longitudinal tubes 11, 11*a*. It should be pointed out that to provide a certain compacting effect for the fabric in said channel 10, the two sets of tubes 11 will tend to approach at the channel outlet location 12.

The longitudinal tubes 11 are welded on tubular crosspieces 13. Plates 14 and braces 15 (comprising channel sections) are welded on the outermost lower tubes 11*a* and together with the plates and stringers or plates 16 form the sidewalls of channel 10. The stringers 16 are welded at the ends to said plates 14. The plates 14 carry at the top a number of pins 17 which are clamped in the slotted ends of sleeves 18, the upper set of tubes 11 being secured thereto.

At the inlet end 19 of channel 10, said lower tubes 11 terminate welded on a tube 20 (FIG. 2) which in turn is welded on two slotted sleeves 20A which by means of screws are clamped on a shaft 21 passing through the flanks 22 of said tank 1 and the ends of which are mounted on bearings 23 carried by the parts or members 2A of structure 2. This shaft is the axis of oscillation for the channel 10.

At the outlet end 12 of channel 10, the lower tubes 11, 11a terminate welded on a tube 24 (FIG. 4) which is welded in turn on two slotted sleeves 24A which by means of screws are secured on a shaft 25 passing through the flanks 22 of tank 1 by nylon bushings 26 (through openings 26A), and the ends of which carry ball bearings 27. Sealing is ensured by flexible sleeves 100 secured on one side to the tube 24 and on the other side to said flanks 22.

These bearings 27 enter the groove 28 of a cam 29 (one on each side). The cams 29 are keyed on a shaft 30 passing through the tank along a tube 32 which is secured to the flanks 22 and supported by bearings 31 (carried in said structure 2) and is driven by a speed reduction unit 33 through a drive comprising gear wheels 34 and chains 35.

A roller 36 (FIG. 1) enters the groove 28 of cam 29 and is carried at the end of a laminated spring 37 which is attached at an end to said structure 2.

The operation of the described apparatus is as follows.

The looped fabric extends on and between the cylinders 5, 7, 8 and 9 and in the channel 10. A given amount of processing liquid is contained in the tank 1. The speed reduction unit 34 is operated, whereby the cams 29 rotate, imparting an oscillating movement to the channel 10 about the shaft 21 to and away from the tank bottom 4.

As the pervious channel 10 is moved to the bottom of the tank, the processing liquid is mostly forcibly urged through the fabric moving along the channel. Upon movement in opposite direction, the liquid filtrates through the fabric in a direction opposite to the first direction.

The fabric 6 accumulates and compacts in said channel 10 not only because the fabric tends to move downwards along the channel, but also because the outlet end of the channel is narrower and the fabric loop has a substantially larger extension than the travelled path.

In order to enhance the liquid action (since as the channel moves, a fraction of the liquid does not affect the fabric, but moves away and escapes laterally of the channel 10), a side seal (FIG. 3) is provided and comprises a pair of parallel sides 40, downwardly extending from the lower wall of channel 10, gaskets being secured thereto, such as nylon gaskets 41, which seals slidingly cooperate with counterseals comprising U-sections 42 secured on the tank bottom. As the channel moves, the seals will move along said counterseals 42.

In order to provide for or promote the fabric feeding, sections such as 50 (FIG. 1) can be secured on the underside of channel 10, the front faces 50A of which are inclined, so as to cause the water (as the channel is lowered) to move in the direction of arrow B, with a resulting build-up of a feeding bias on the fabric.

The inventive concept can be extended to approaches for different applications. For example, apparatus similar to that hereinabove described could be used, as serially connected to one another and such that the fabric, no longer at a looped condition, will move from one to another apparatus, thus providing a continuously operating machine.

Figure 5:
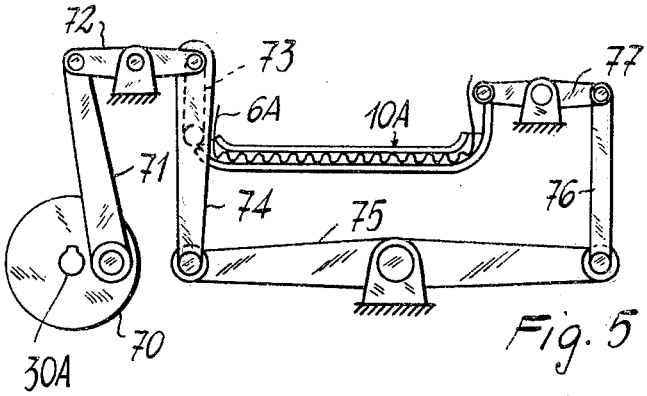
FIG. 5 is a schematic side elevational view showing another embodiment of the invention as restricted to the pervious channel and mechanism operating the latter.

An embodiment has been extremely schematically shown in FIG. 5, without taking into account the mutual dimensional ratios.

The pervious channel 10A, for example of a similar construction as in the above described first embodiment, has a fabric 6A moving therethrough, wherein a fabric standstill is cause for one or more of the reasons as set forth for the first embodiment. Instead of an arcuate extension as channel 10, this channel 10A is substantially straight, except for the ends where it is curved.

The tank, not shown but corresponding to tank 1, will have a bottom substantially corresponding to the extension of channel 10A, thus being different from the bottom 4 of tank 1.

A speed reduction unit, not shown, rotably drives a shaft 30A, such as by a chain drive. At each of its ends said shaft 30A carries a crank 70 which through a connecting rod 71 is connected to the end of a rocking lever 72.

An arm 73 is pivoted to the other end of each rocking lever 72 and articulated to the inlet end of the channel 10A. At the same end of the rocking lever, a rod 74 is pivoted and has an articulated termination to the end of a main rocking lever 75. The other end of said main rocking lever 75 is connected through an arm 76 and a rocking lever 77 to an extension of the outlet end of channel 10A.

The operation can be readily understood from the foregoing description. The rotation of crank 70 causes a complex movement of the whole channel 10A with respect to the tank bottom (not shown), with a resulting active participation of the whole channel (that is from end to end) to the fabric processing.

As readily understood, this complex motion comprises a component directed to the tank bottom, so that the channel alternately moves to and away from said bottom.

Any other mechanical approach enabling to cause the desired movement to and away from the bottom of the whole channel will obviously come within the scope of the invention.

What I claim is:

1. In an apparatus for processing fabric or the like, tank means for containing a processing liquid and having a bottom wall, elongated hollow channel means in said tank means, means for directing fabric through said channel means, said channel means having an entrance end for receiving fabric and an opposite exit end through which the fabric leaves said channel means, and said channel means being situated in said tank means for submersion in the processing liquid therein, moving means operatively connected with said channel means for moving said channel means toward and away from said bottom wall of said tank means, said channel means having an upper elongated portion distant from said bottom wall of said tank means and a lower elongated portion nearer to said bottom wall of said tank means than said upper portion thereof, and both of said portions of said channel means being formed with a plurality of openings through which the processing liquid can freely pass, said elongated channel means having opposed side walls, a pair of opposed impervious baffles fixed to said channel means and extending downwardly from said lower portion thereof and extending along said side walls, and means carried by said bottom wall of said tank means and cooperating with said baffles for confining between said baffles processing liquid which thus is prevented from escaping laterally.

2. The combination of claim 1 and wherein said channel means is pivotally connected at one end to said tank means while said means for moving said channel means is operatively connected to an opposite end of said channel means.

3. The combination of claim 2 and wherein the pivotally connected end of said channel means is said entrance end thereof.

4. The combination of claim 1 and wherein said upper and lower portions of said channel means are made up of longitudinally and transversely extending elongated members which are fixed to each other while defining between themselves the openings through which the processing liquid can freely pass.

5. The combination of claim 1 and wherein said elongated channel means has opposed side walls also formed together with said upper and lower portions with openings through which the liquid can freely pass.

6. The combination of claim 1 and wherein said lower portion of said channel means carries transversely extending baffles having, extending across said channel means, transverse surfaces which are inclined with respect to said bottom wall of said tank means for urging processing liquid to flow from said entrance toward said exit end of said channel means during movement of the latter with respect to said bottom wall so that the thus-flowing liquid will contribute to the progress of the fabric through said channel means.

7. The combination of claim 1 and wherein said means for moving said channel means toward and away from said bottom wall of said tank means is operatively connected to said channel means for displacing the latter in its entirety toward and away from said bottom wall of said tank means without tilting said channel means and without moving the same longitudinally.

8. The combination of claim 7 and wherein a single drive means cooperates with said means for moving said channel means toward and away from said bottom wall of said tank means with the said moving means being operatively connected to both ends of said channel means.

9. The combination of claim 1 and wherein said channel means is narrower at its exit end than at its entrance end.

10. The combination of claim 1 and wherein said channel means has at least at its exit end an upwardly curved portion for causing the fabric to gather in said channel means.

* * * * *